US005648205A

United States Patent [19]

Okutsu

[11] Patent Number: 5,648,205

[45] Date of Patent: Jul. 15, 1997

[54] PROCESSING METHOD FOR SILVER HALIDE PHOTOGRAPHIC MATERIAL

[75] Inventor: Eiichi Okutsu, Minami Ashigara, Japan

[73] Assignee: Fuji Photo Film Co., Ltd., Kanagawa, Japan

[21] Appl. No.: 659,245

[22] Filed: Jun. 5, 1996

Related U.S. Application Data

[63] Continuation-in-part of Ser. No. 540,308, Oct. 6, 1995, abandoned.

[30] Foreign Application Priority Data

Oct. 13, 1994 [JP] Japan ..... 6-247937

[51] Int. Cl.[6] ..... G03C 5/305

[52] U.S. Cl. ..... 430/440; 430/446; 430/480; 430/483; 430/488; 430/492

[58] Field of Search ..... 430/440, 441, 430/446, 480, 483, 492, 488

[56] References Cited

U.S. PATENT DOCUMENTS

| | | | |
|---|---|---|---|
| 2,688,548 | 9/1954 | Reynolds | 430/480 |
| 2,688,549 | 9/1954 | James et al. | 95/88 |
| 3,658,527 | 4/1972 | Kunz et al. | 430/436 |
| 3,870,479 | 3/1975 | Kubotera et al. | 430/480 |
| 3,938,997 | 2/1976 | Fisch et al. | 430/399 |
| 4,427,762 | 1/1984 | Takahashi et al. | 430/436 |
| 5,098,819 | 3/1992 | Knapp | 430/436 |
| 5,196,298 | 3/1993 | Meeus et al. | 430/440 |
| 5,236,816 | 8/1993 | Purol et al. | 430/492 |
| 5,264,323 | 11/1993 | Purol et al. | 430/440 |
| 5,278,035 | 1/1994 | Knapp | 430/452 |
| 5,364,746 | 11/1994 | Inoue et al. | 430/480 |
| 5,376,510 | 12/1994 | Parker et al. | 430/440 |

FOREIGN PATENT DOCUMENTS

| | | | |
|---|---|---|---|
| 0585792 | 3/1994 | European Pat. Off. | 430/399 |
| 59-191035 | 1/1984 | Japan | 430/440 |
| 3-249756 | 11/1991 | Japan . | |
| 560371 | 3/1944 | United Kingdom | 430/440 |

*Primary Examiner*—Hoa Van Le

*Attorney, Agent, or Firm*—Sughrue, Mion, Zinn, Macpeak & Seas

[57] ABSTRACT

A processing method for a silver halide photographic material is described, which comprises developing an exposed silver halide photographic material with a developing solution comprising:

(a) an ascorbic acid developing agent, (b) an auxiliary developing agent exhibiting superadditivity, (c) an alkali agent necessary to maintain the pH from 9.2 to 9.8, and (d) a carbonate in a concentration from 0.30 mol/liter to 0.60 mol/liter.

18 Claims, No Drawings

PROCESSING METHOD FOR SILVER HALIDE PHOTOGRAPHIC MATERIAL

CROSS-REFERENCE TO RELATED APPLICATION

This application is a continuation in part of U.S. application Ser. No. 08/540,308, filed Oct. 6, 1995, now abandoned, the entire disclosure of which is expressly incorporated herein by reference.

FIELD OF THE INVENTION

The present invention relates to a processing method comprising developing a silver halide photographic material and, in particular, to a processing method comprising developing a black-and-white silver halide photographic material using a developing agent different from hydroquinone.

BACKGROUND OF THE INVENTION

Black-and-white silver halide photographic materials generally used (for example, for X-ray photography, for photomechanical process, as a microfilm and a negative film) are developed with development processing comprising a development step using an alkaline developing solution comprising hydroquinone as a developing agent, and 3-pyrazolidone based compounds or aminophenol based compounds as an auxiliary developing agent, a fixing step and a washing step in this order to form an image. Above all, in particular, an X-ray photographic material contains a comparatively large amount of silver halide and is subjected to development processing with a high active developing solution containing a large amount hydroquinone developing agent for achieving rapid processing. A large quantity of such a developing solution is replenished against air oxidation to maintain high activity. However, the toxicity and safety of hydroquinone itself have become a problem. The methods of using ascorbic acid and the like as a substitute for hydroquinone as a developing agent are disclosed in U.S. Pat. Nos. 2,688,549, 5,278,035, 5,236,816, 5,098,819 and JP-A-3-249756 (the term "JP-A" as used herein refers to "a published unexamined Japanese patent application"). However, there are no descriptions about methods for stably processing photographic materials using them by means of an automatic processor, further, a processing method comprising developing a silver halide photographic material with replenishing a replenisher at a reduced replenishing rate per unit area of the photographic material has not been known yet.

SUMMARY OF THE INVENTION

Accordingly, the first object of the present invention is to provide a processing method comprising stably developing a silver halide photographic material (in particular, a black-and-white photographic material) with a developing solution comprising an ascorbic acid developing agent in place of hydroquinone as a developing agent, with which the silver halide photographic material achieves high sensitivity and which causes no contamination of an automatic processor. Further, as the waste solution of the developing solution has high chemical oxygen demand (so called C.O.D.) and high biological oxygen demand (so-called B.O.D.), the second object of the present invention is to reduce the replenishment rate per unit area of a silver halide photographic material (in particular, a black-and-white photographic material) to lessen an economical load of waste solution disposal.

The above objects of the present invention can be attained by means of a processing method for a silver halide photographic material which comprises developing an exposed silver halide photographic material with a developing solution comprising:

(a) an ascorbic acid developing agent, (b) an auxiliary developing agent exhibiting superadditivity, (c) an alkali agent necessary to maintain the pH from 9.2 to 9.8, and (d) a carbonate in a concentration from 0.30 mol/liter to 0.60 mol/liter.

Further, the above objects of the present invention can be attained by maintaining the above composition of the developing solution by feeding the developing solution with replenisher for developing solution at the replenishment rate of not more than 250 ml per $m^2$ of the photographic material.

Still further, a development processing accompanied by less silver stain can be performed and the above objects of the present invention can be attained by adding, in the above composition of the developing solution, the compound represented by formula (I) or (II):

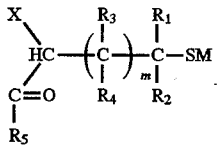

(I)

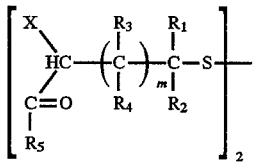

(II)

wherein $R_1$ and $R_2$ each represent a hydrogen atom, an alkyl group having from 1 to 3 carbon atoms or a phenyl group; $R_3$ and $R_4$ each represent a hydrogen atom or an alkyl group having from 1 to 3 carbon atoms; m represents 0, 1 or 2; $R_5$ represents a hydroxyl group, an amino group or an alkyl group having from 1 to 3 carbon atoms; M represents a hydrogen atom, an alkali metal atom or an ammonium group; and X represents a hydrogen atom, an alkyl group having from 1 to 3 carbon atoms, a sulfonyl group, an amino group, an acylamino group, a dimethylamino group, an alkylsulfonylamino group or an arylsulfonylamino group.

DETAILED DESCRIPTION OF THE INVENTION

Specific examples of particularly preferred ascorbic acid and derivatives thereof for use in the present invention are shown below, but the present invention is not limited thereto.

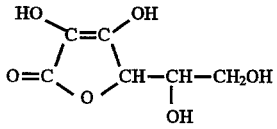

5-1

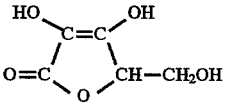

5-2

-continued

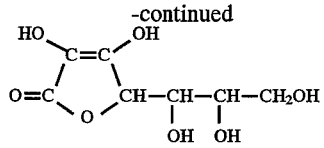

5-3

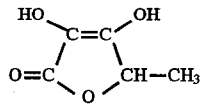

5-4

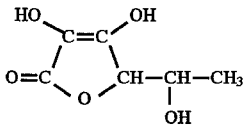

5-5

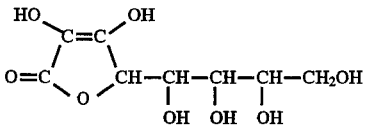

6-1

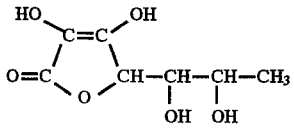

6-2

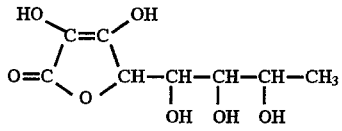

6-3

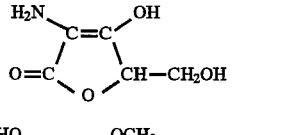

6-4

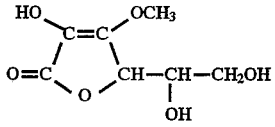

6-5

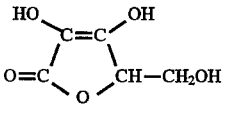

6-6

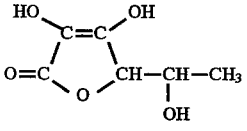

6-7

By the term, "an ascorbic acid developing agent", as used herein, it is intended to include ascorbic acid and the analogues, isomers and derivatives thereof which function as photographic developing agents. Ascorbic acid developing agents are very well known in the photographic art (see U.S. Pat. Nos. 2,688,549, 5,278,035, 5,236,816, 5,098,819 and JP-A-3-249756, cited hereinabove) and include, for example, the following compounds:

L-ascorbic acid
D-ascorbic acid
L-erythroascorbic acid
6-desoxy-L-ascorbic acid
L-rhamnoascorbic acid
D-glucoheptoascorbic acid
imino-L-erythroascorbic acid
imino-D-glucoascorbic acid
imimo-6-desoxy-L-ascorbic acid
imino-D-glucoheptoascorbic acid
sodium isoascorbate
L-glycoascorbic acid
D-galactoascorbic acid
L-araboascorbic acid
sorboascorbic acid
sodium ascorbate
and the like.

The ascorbic acid developing agent for use in the present invention can be used in the form of an alkali metal salt such as a lithium salt, a sodium salt, or a potassium salt. These ascorbic acids are used in an amount of from 1 to 100 g, preferably from 5 to 80 g, per liter of the developing solution.

The ascorbic acid developing agent may be one or more compounds selected from the group consisting of an ascorbic acid and derivatives of ascorbic acid.

Examples of auxiliary developing agents exhibiting superadditivity include 3-pyrazolidone based developing agents and p-aminophenol based developing agents.

Examples of 3-pyrazolidone based developing agents include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone, etc.

Examples of p-aminophenol based developing agents include N-methyl-p-aminophenol, p-aminophenol, N-(β-hydroxyethyl)-p-aminophenol, N-(4-hydroxyphenyl) glycine, 2-methyl-p-aminophenol, p-benzylaminophenol, etc., and N-methyl-p-aminophenol is particularly preferred of them.

These auxiliary developing agents are preferably used in amount of from $10^{-4}$ to $10^{-1}$ mol/liter and more preferably from $5\times10^{-4}$ to $5\times10^{-2}$ mol/liter.

Examples of alkali agents necessary to maintain the pH from 9.2 to 9.8 include sodium hydroxide, potassium hydroxide, sodium dihydrogen phosphate, disodium hydrogen phosphate, tripotassium phosphate, dipotassium hydrogen phosphate, etc. Examples of carbonates for use in the present invention include sodium hydrogencarbonate, sodium carbonate, potassium hYdrogencarbonate, potassium carbonate, etc.

Preferred examples of the compounds represented by formula (I) or (II) which can be used in the present invention are shown below.

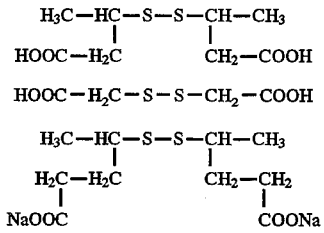

7-1

$HOOC-H_2C-S-S-CH_2-COOH$ 7-2

7-3

α-Mercaptoisobutyric acid 7-4

$HOOC(CH_2)_2-S-S-(CH_2)_2COOH$ 7-5

$HOOC(CH_2)_3-S-S-(CH_2)_3COOH$ 7-6

-continued

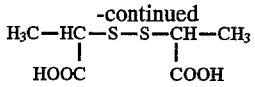

Thiolactic acid 7-7

7-8

8-1

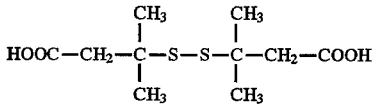

8-2

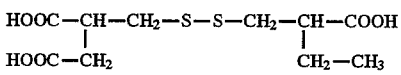

8-3

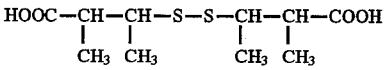

8-4

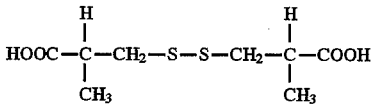

8-5

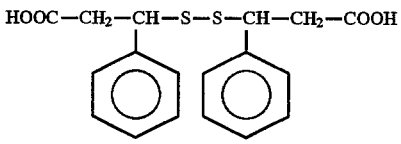

8-6

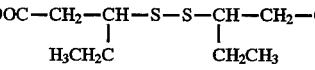

8-7

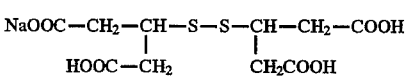

9-1

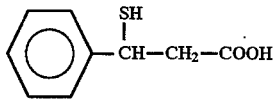

9-2

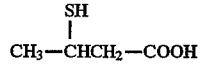

9-3

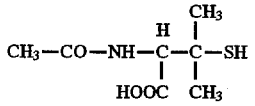

9-4

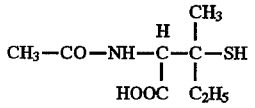

9-5

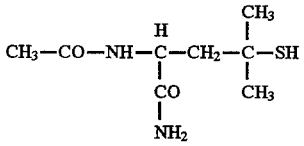

Preferred concentration of the compounds represented by formula (I) or (II) of the present invention in the developing solution (working solution) is from 0.01 mmol to 50 mmol/liter, more preferably from 0.05 mmol to 10 mmol/liter, and particularly preferably from 0.1 mmol to 5 mmol/liter.

A development inhibitor such as potassium bromide and potassium iodide; an organic solvent such as dimethylformamide, methyl cellosolve, hexylene glycol, ethanol and methanol; and a benzotriazole derivative such as 5-methylbenzotriazole, 5-bromobenzotriazole, 5-chlorobenzotriazole, 5-butylbenzotriazole, benzotriazole, etc., particularly preferably benzotriazole, can be used in the present invention.

Examples of sulfite preservatives which can be used in the developing solution for use in the present invention include sodium sulfite, potassium sulfite, lithium sulfite, ammonium sulfite, sodium bisulfite, potassium metabisulfite, etc. Preferred addition amount of the sulfite preservative is 0.01 mol/liter or more, particularly preferably 0.02 mol/liter or more, and the upper limit is preferably 1.0 mol/liter.

In addition to the above, those compounds disclosed in L. F. A. Mason, *Photographic Processing Chemistry*, pages 226 to 229, The Focal Press (1966), U.S. Pat. Nos. 2,193,015, 2,592,364, and JP-A-48-64933 can be used in the present invention.

Further, a toning agent, a surfactant, a water softener, and a hardener may be included, if necessary.

A chelating agent for use in the developing solution of the present invention include, for example, ethylene-diaminedi-o-hydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, trans-cyclohexanediaminetetraacetic acid, ethylene-diaminetetraacetic acid, glycol ether diaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,4-disulfonic acid, sodium pyrophosphate, sodium tetrapolyphosphate, and sodium hexametaphosphate, and particularly preferably diethylene-triaminepentaacetic acid, triethylenetetraminehexaacetic acid, 1,3-diaminopropanoltetraacetic acid, glycol ether diaminetetraacetic acid, hydroxyethylethylenediaminetriacetic acid, 2-phosphonobutane-1,2,4-tricarboxylic acid, 1,1 diphosphonoethane-2-carboxylic acid, nitrilotrimethylenephosphoric acid, ethylenediaminetetraphosphonic acid, diethylenetriaminepentaphosphonic acid, 1-hydroxypropylidene-1,1-diphosphonic acid, 1-aminoethylidene-1,1-diphosphonic acid, 1-hydroxyethylidene-1,1-diphosphonic acid and salts of these compounds.

Packaging materials for a developing solution may be packaging materials having an oxygen permeation coefficient of 50 ml/m$^2$.atm.day (temperature of 20° C. and relative humidity of 65%) or less and a thickness of 1 mm or more, but are preferably containers of plastic packaging materials comprising at least one of saponification product of ethylene-vinyl acetate copolymer and nylon and having an oxygen permeation coefficient of 50 ml/m$^2$.atm.day (temperature of 20° C. and relative humidity of 65%) or less and a thickness of 0.5 mm or less which are flexible and easily handleable.

More preferably, containers of plastic packaging materials having an oxygen permeation coefficient of 25 ml/m$^2$.atm.day (temperature of 20° C. and relative humidity of 65%) or less can preserve a developing solution put in the container for a long period of time without adversely affecting photographic abilities.

An oxygen permeation coefficient can be measured according to the method disclosed in N. J. Calvano et al., *$O_2$ Permeation of Plastic Container, Modern Packing*, pages 143 to 145, (December, 1968).

The processing solutions for use in the present invention can be prepared according to the methods disclosed in JP-A-61-177132, JP-A-3-134666 and JP-A-3-67258. The replenishing method disclosed in JP-A-5-216180 can be used as the replenishing method of the developing solution for the processing method of the present invention.

In the processing method of the present invention, it is preferred that the composition of the developing solution (processing tank solution) for use in the present invention is maintained with feeding the developing solution with a replenisher for developing solution at the replenishment rate of not more than 250 ml per $m^2$ of photographic material, with the replenishment rate being more preferably 50 to 250 $ml/m^2$ and particularly preferably 100 to 200 $ml/m^2$.

The fixing solution for use in the present invention is an aqueous solution containing thiosulfate and having pH of 3.8 or more, preferably from 4.2 to 6.2.

Sodium thiosulfate and ammonium thiosulfate are used as a fixing agent. The amount used of the fixing agent can be varied optionally and the fixing solution may contain an aluminum salt soluble in water which functions as a hardening agent, such as aluminum chloride, aluminum sulfate and potassium alum.

The fixing solution can contain one or two or more of tartaric acid, citric acid, gluconic acid or derivatives of them. These compounds are effectively contained in an amount of 0.005 mol or more, particularly effectively from 0.01 mol to 0.03 mol, per liter of the fixing solution.

The fixing solution can contain, if necessary, a preservative (e.g., sulfite, bisulfite), a pH buffer (e.g., acetic acid, boric acid), a pH adjuster (e.g., sulfuric acid), a chelating agent having a water softening ability and the compounds disclosed in JP-A-62-78551.

The methods disclosed in JP-A-1-4739 and JP-A-3-101728 can be used as the processing method of the present invention for accelerating fixation.

In the above processing method of the present invention, photographic materials are, after the processes of development and fixation, processed with a washing water or a stabilizing solution and dried.

Various types of automatic processors such as a roller transport type and a belt transport type can be used in the present invention but a roller transport type automatic processor is preferably used. Further, by using the automatic processors having the developing tanks of a small open factor as disclosed in JP-A-1-166040 and JP-A-1193853, air oxidation and evaporation can be reduced. Photographic materials are dried after the water content is squeezed out of the materials, that is, through squeegee rollers.

The washing water for use in the present invention is sometimes more preferably subjected to pretreatment before being supplied to a washing tank such that the contaminants and organic materials in the water are removed through filter parts and/or activated carbon filters.

Various known antimicrobial means can be used in combination in the present invention, such as the ultraviolet irradiation method disclosed in JP-A-60-263939, the method utilizing magnetic field disclosed in JP-A-60-263940, the method of making demineralized water using an ion exchange resin disclosed in JP-A-61-131632, the method in which water is circulated through the filter and the adsorbent column while blowing ozone disclosed in JP-A-4-151143, the method of decomposing microbes disclosed in JP-A-4-240636, and the methods of using microbicide disclosed in JP-A-62-115154, JP-A-62-153952, JP-A-62-220951 and JP-A-62-209532.

In addition, the microbicide, fungicides, and surfactants disclosed in M. W. Beach, "Microbiological Growths in Motion Picture Processing", *SMPTE Journal*, Vol. 85 (1976), R. O. Deegan, "Photo Processing Wash Water Biocides", *J. Imaging Tech.*, Vol. 10, No. 6 (1984), JP-A-57-8542, JP-A-57-58143, JP-A-58-105145, JP-A-57-132146, JP-A-58-18631, JP-A-57-97530 and JP-A-57-257244 can be used in combination, if desired.

Moreover, the isothiazoline based compounds and bromochlorodimethylhydantoin disclosed in R. T. Kreiman, *J. Image. Tech.*, Vol. 10, No. 6, page 242 (1984), the isothiazoline based compounds disclosed in *Research Disclosure*, Vol. 205, No. 20526 (May, 1981), and *ibid.*, Vol,. 228, No. 22845 (April, 1983), and the compounds disclosed in JP-A-62-209532 can be used in combination as a microbicide in a washing bath (or a stabilizing bath), if desired.

In addition, the compounds disclosed in Hiroshi Horiguchi, *Bohkin Bohbai no Kagaku* (*Antibacterial and Antifungal Chemistry*), Sankyo Shuppan K. K. (1982), *Bohkin Bohbai Gijiutsu Handbook* (*Handbook of Antibacterial and Antifungal Technology*, edited by Nippon Bohkin Bohba Gakkai, published by Hakuhodo (1986) may be contained in a washing water or a stabilizing solution.

Photographic materials having been developed, fixed and washed (or stabilized) are dried after the water content is squeezed out of the materials, that is, through squeegee rollers. Drying is carried out at about 40° C. to about 100° C., and the drying time can be varied arbitrarily depending on the circumferential conditions but is generally from about 5 seconds to 3 minutes and particularly preferably at 40° to 80° C. for about 5 seconds to 2 minutes.

When development processing is carried out by rapid development processing of dry to dry of less than 100 seconds, to avoid the development unevenness peculiar to rapid processing, it is preferred that the rubber rollers disclosed in JP-A-63-151943 are provided at the outlet of the developing tank, the discharge flow rate for stirring the developing solution in the developing tank is set at 10 m/min or more as disclosed in JP-A-63-151944, and that stirring a least during development processing is stronger than during waiting as disclosed in JP-A-63-264758.

The photographic material of the present invention is not particularly limited and is primarily used as a black-and-white photographic material. In particular, the photographic material of the present invention can be used as a photographic material for a laser light source, for printing, for medical X-ray direct photographing, for medical X-ray indirect photographing, for CRT image recording, as a microfilm, and as a film for general photographing.

The emulsion grains in the silver halide photographic material for use in the present invention are described below. The diameter of the sphere corresponding to the same volume as that of the emulsion grain (hereinafter "average grain size corresponding to sphere") is preferably 0.05 μm or more and less than 2.0 μm. The grain size distribution is preferably narrow. The silver halide grains in the emulsion may have a regular crystal form such as a cubic, octahedral or tetradecahedral form, an irregular crystal form such as a spherical, plate-like or pebble-like form, or a form which is a composite of various crystal forms. The grains may be tabular grains having the grain diameter 4 times or more as much as the grain thickness. (Details are disclosed in *Research Disclosure*, Vol. 225, Item 22534, pages 20 to 58 (January, 1983), JP-A-58-127921 and JP-A-58-113926.) The tabular silver halide grains can be prepared using the known methods in the art in combination arbitrarily. The tabular silver halide emulsion can easily be prepared according to the methods disclosed in JP-A-58-127921, JP-A-58-113927, JP-A-58-113928, and U.S. Pat. No. 4,439,520. The projected area diameter of the tabular emulsion of the present invention is preferably from 0.3 to 2.0 μm, particularly preferably from 0.5 to 1.2 μm. Further, the distance between the parallel planes (the thickness of the grain) is preferably from 0.05 μm to 0.3 μm, particularly preferably from 0.1 to 0.25 μm, and the aspect ratio is preferably 3 or more and less than 20, particularly preferably 4 or more and less than 15. It is preferred that the silver halide grains having aspect ratio of 2 or more account for 50% (projected area) or more, particularly preferably 70% or more, of the entire silver halide grains of the tabular silver halide emulsion of the present invention and average aspect ratio of the tabular grains is preferably 3 or more, particularly preferably from 4 to 15.

When average aspect ratio is 4 or less, the optical density is low, therefore, it is not desired. The total silver amount (inclusive of both sides) is preferably not more than 3.2 $g/m^2$, more preferably not more than 3.0 $g/m^2$. When the total silver amount is more than 3.2 $g/m^2$, consumption of the developing agent during processing of the photographic material is large, the pH of the developing solution lowers largely, further, bromine ion is largely released to the developing solution, as a result, the activity of the developing solution lowers, therefore, it is not desired. In particular, when the developing agent is ascorbic acid based compound, the reduction of pH due to development is larger compared with the hydroquinone developing agent, accordingly, the total silver amount is preferably not more than 3.0 $g/m^2$. The lower limit of the total silver amount is preferably not less than 1.0 $g/m^2$ and more preferably not less than 1.5 $g/m^2$.

The selenium compounds disclosed in conventionally known patents can be used as a selenium sensitizer to effectively utilize the effect of the present invention. The non-unstable selenium compounds disclosed in JP-B-46-4553, JP-B-52-34492 and JP-B-52-34491 (the term "JP-B" as used herein refers to an "examined Japanese patent publication") can be used in the present invention, for example. Examples of the non-unstable selenium compounds include selenious acid, potassium selenocyanide, selenazoles, quaternary salts of selenazoles, diaryl selenide, diaryl diselenide, dialkyl selenide, dialkyl diselenide, 2-selenazolidinedione, 2-selenooxazolidinethione and derivatives of these compounds.

Silver halide solvents which can be used in the present invention include (a) the organic thioethers disclosed in U.S. Pat. Nos. 3,271,157, 3,531,289, 3,574,628, JP-A-54-1019 and JP-A-54-158917, (b) the thiourea derivatives disclosed in JP-A-53-82408, JP-A-55-77737 and JP-A-55-2982, (c) the silver halide solvents having the thiocarbonyl group between an oxygen or sulfur atom and a nitrogen atom disclosed in JP-A-53-144319, (d) the imidazoles disclosed in JP-A-54-100717, (e) sulfite, and (f) thiocyanate. Particularly, preferred are thiocyanate and tetramethylthiourea. The amount of the solvent used is varied depending on the kind of the solvent, for example, thiocyanate is preferably used in an amount of from $1\times10^{-4}$ mol to $1\times10^{-2}$ mol per mol of the silver halide. The silver halide photographic emulsion of the present invention can achieve high sensitivity and low fog by the combined use of sulfur sensitization and/or gold sensitization. Sulfur sensitization is usually carried out by adding a sulfur sensitizer and stirring the emulsion for a predetermined period of time at high temperature, preferably 40° C. or more. Gold sensitization is usually carried out by adding a gold sensitizer and stirring the emulsion for a predetermined period of time at high temperature, preferably 40° C. or more. Known sulfur sensitizers can be used for the above sulfur sensitization, for example, thiosulfate, thioureas, allyl isothiacyanate, cystine, p-toluenethiosulfonate, and rhodanine. In addition to the above, the sulfur sensitizers disclosed in U.S. Pat. Nos. 1,574,944, 2,410,689, 2,278,947, 2,728,668, 3,501,313, 3,656,955, German Patent 1,422,869, JP-B-56-24937 and JP-A-55-45016 can also be used. The addition amount of, sulfur sensitizers may be sufficient to effectively increase the sensitivity of the emulsion. The addition amount varies in a considerable wide range according to various conditions such as the pH, temperature and size of silver halide grain but is preferably from $1\times10^{-7}$ mol to $5\times10^{-4}$ mol per mol of the silver halide.

The oxidation number of the gold sensitizers of the above described gold sensitization may be monovalen or trivalent and gold compounds usually used as gold sensitizers can be used. Representative examples thereof include chloroaurate, potassium chloroaurate, auric bichloride, potassium auric thiocyanate, potassium iodoaurate, tetracyanoauric acid, ammonium aurothiocyanate, and pyridyl trichloro-gold. The addition amount of the gold sensitizers varies according to various conditions but is preferably from $1\times10^{-7}$ to $5\times10^{-4}$ mol per mol of the silver halide as a criterion.

To effectively utilize the effect of the present invention, it is preferred that 0.5 mmol or more of silver halide adsorptive material per mol of the silver halide be present during chemical sensitization in the emulsion preparation process as disclosed in JP-A-2-68539. This silver halide adsorptive material may be added at any time of during grain formation, immediately after grain formation, or before or after the commencement of after-ripening, but is preferably added before or simultaneously with the addition, of chemical sensitizers (e.g., gold or sulfur sensitizers), and the adsorptive material should be present at least during the process of chemical sensitization progress. The silver halide adsorptive material may be added at an arbitrary condition of from 30° C. to 80° C. but is preferably added at from 50° C. to 80° C. to increase adsorptivity. The pH and pAg thereof may be optional but preferably pH is from 5 to 10 and pAg is from 7 to 9 at the time of chemical sensitization.

The silver halide adsorptive material herein means such as a sensitizing dye or a photographic ability stabilizer. That is, many compounds known as antifoggants and stabilizers can be enumerated as silver halide adsorptive materials, for example, azoles (e.g., benzothiazolium salt, benzimidazolium salt, imidazoles, benzimidazoles, nitroindazoles, triazoles, benzotriazoles, tetrazoles, triazines); mercapto compounds (e.g., mercaptothiazoles, mercaptobenzothiazoles, mercaptoimidazoles, mercaptobenzimidazoles, mercaptobenzoxazoles, mercaptothiadiazoles, mercaptooxadiazoles, mercaptotetrazoles, mercaptopyrimidines, mercaptotriazines); thiokero compounds, e.g., oxazolinethione; and azaindenes (e.g., triazaindenes, tetraazaindenes (particularly 4-hydroxy-substituted(1,3,3a,7) tetraazaindenes), pentaazaindenes) In addition, purines, nucleic acids and the high molecular compounds disclosed in JP-B-61-36213 and JP-A-59-90844 can also be used as the silver halide adsorptive material.

Sensitizing dyes which can be effectively used as a silver halide adsorptive material include, for example, a cyanine dye, a merocyanine dye, a complex cyanine dye, a complex merocyanine dye, a holopolar cyanine dye, a styryl dye, a hemicyanine dye, an oxonol dye and a hemioxonol dye. Useful sensitizing dyes which can be used in the present invention are disclosed, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, and 2,503,776, JP-A-48-76525 and Belgian Patent 691,807.

The photographic emulsion layers or other hydrophilic colloid layers of the photographic material may contain various surfactants for the purpose of coating aid, static charge prevention, improvement of sliding property, emulsifying dispersion, adhesion prevention, and improvement of photographic abilities (e.g., development acceleration, hardening and sensitization).

Gelatin is preferably used as a binder or protective colloid for an emulsion layer, an interlayer or a surface protective layer of a photographic material, but other hydrophilic colloids can also be used. Examples thereof include proteins such as gelatin derivatives, graft polymers of gelatin and other high polymers, albumin and casein; sugar derivatives such as cellulose derivatives such as hydroxyethyl cellulose, carboxymethyl cellulose, and cellulose sulfate, sodium alginate, dextran, and starch derivatives; and various kinds of synthetic hydrophilic high polymers of homopolymers or copolymers such as polyvinyl alcohol, partially acetalated polyvinyl alcohol, poly-N-vinyl pyrrolidone, polyacrylic acid, polymethacrylic acid polyacrylamide, polyvinylimidazole, and polyvinylpyrazole. Acid-processed gelatin and enzyme-processed gelatin can be used as well as lime-processed gelatin, and hydrolyzed product and enzyme decomposed product of gelatin can also be used. Above all, the combined use of dextran and polyacrylamide having an average molecular weight of 50,000 or less with gelatin is preferred. The methods disclosed in JP-A-63-68837 and JP-A-63-149641 are effective for the present invention.

A photographic emulsion and light-insensitive an inorganic or hydrophilic colloid may contain organic hardening agent. For example, chromium salt (e.g., chrome alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloyl-hexahydro-s-triazine, bis (vinylsulfonyl)methyl ether, N,N'-methylenebis[β-(vinylsulfonyl)propionamide]), active halide compounds (e.g., 2,4-dichloro-6-hydroxy-s-triazine), mucohalogenic acids (e.g., mucochloric acid, mucophenoxychloric acid), isoxazoles, dialdehyde starch, and 2-chloro-6-hydroxytriazinylated gelatin can be used alone or in combination. Above all, the active vinyl compounds disclosed in JP-A-53-41221, JP-A-53-57257, JP-A-59-162546 and JP-A-60-80846, and the active halide compounds disclosed in U.S. Pat. No. 3,325,287 are preferably used.

The swelling factor in water of the hydrophilic colloid layer of the photographic material is preferably suppressed to 280% or less by these hardening agents, with the swelling factor in water of the hydrophilic colloid layer being more preferably from 150% to 280% and particularly preferably from 170% to 200%. The swelling factor in water of the present invention is measured by freeze drying method. That is, the swelling factor of the hydrophilic colloid layer is measured after the photographic material is allowed to stand under the conditions of 25° C. and 60% RH for 7 days. The dry thickness (a) is determined by measuring a sliced piece of the film by a scanning type electron microscope The swollen film thickness (b) is determined by measuring the photographic material after being immersed in a distilled water set at 21° C. for 3 minutes and then, freeze dried by liquid nitrogen by a scanning type electron microscope. The swelling factor is the value obtained by the expression $[(b)-(a)]\div(a)\times 100$ (%).

The emulsion layer of the photographic material can contain a plasticizer such as polymers or emulsified products to improve pressure characteristics. For example, the methods of using heterocyclic compounds are disclosed in British Patent 738,618, alkylphthalates in British Patent 738,637, alkyl esters in British Patent 738,639, polyhydric alcohols in U.S. Pat. No. 2,960,404, carboxyalkyl cellulose in U.S. Pat. No. 3,121,060, paraffin and carboxylate in JP-A-49-5017, and alkylacrylate and organic acids in JP-A-53-28086. There are no particular limitations on other constitutions of the emulsion layer of the silver halide photographic material of the present invention and various additives can be used according to necessity. For example, the binders, surfactants, other dyes, coating aids and thickeners disclosed in *Research Disclosure*, Vol. 176, pages 22 to 28 (December, 1978) can be used.

In the silver halide photographic material provided with photographic emulsion layers on both sides of the support, a problem exists such that the image quality is liable to deteriorate due to the crossover light. The crossover light is a visible light emitted from each sensitizing screen disposed on both sides of the photographic material and reaches the light-sensitive layer on the opposite side by transmitting the support (generally a thick support of from 170 to 180 μm or so is used) of the photographic material, and causes deterioration of the image quality (in particular, sharpness).

The less the crossover light, the sharper is the image obtained. There-are various methods of reducing the crossover light and the most preferred method is to fix a dye between the support and the light-sensitive layer, which dye is capable of decoloring by development processing. When the fine crystalloid dyes disclosed in U.S. Pat. No. 4,803,150 are used, fixation and decoloring are good and a large amount of dyes can be contained, therefore, this method is very preferred to reduce the crossover light. According to this method, there is no desensitization due to fixation failure, decoloring of dyes is feasible in processing of 90 seconds and the crossover light can be reduced to 15% or less.

A more preferred dye layer to reduce the crossover light is preferably a layer to which a dye is deposited in high density as far as possible. It is preferred to reduce the coating amount of gelatin as a binder and the film thickness is preferably 0.5 μm or less. However, extremely thin layer is liable to cause adhesion failure, accordingly, most preferred film thickness of the dye layer is from 0.05 to 0.3 μm.

A silver chloride, silver chlorobromide or silver chloroiodobromide emulsion for use in the present invention can be prepared by applying the methods disclosed in P. Glafkides, *Chimie et Physique Photographique*, Paul Montel (1967), G. F. Duffin, *Photographic Emulsion Chemistry*, The Focal Press (1966), V. L. Zelikman, et al., *Making and Coating Photographic Emulsion*, The Focal Press (1964), and so on. That is, any process, such as an acid process, a neutral process, and an ammoniacal process, can be used, in particular, an acid process and a neutral process is preferred in the present invention in the point of reducing fog. Any of a single jet method, a double jet method, and a combination of these methods can be used for reacting a soluble silver salt with a soluble halide to obtain a silver halide emulsion. Further, the so-called reverse mixing method in which silver halide grains are formed in the presence of excess silver ion can also be employed. A double jet method is preferably used to obtain a monodisperse emulsion which is preferred in the present invention. The so-called controlled double jet method, which is one form of a double jet method, in which the silver ion concentration of the liquid phase in which the silver halide is formed is maintained constant is more preferably used. According to this method, a silver halide emulsion having a regular crystal form of silver halide and a narrow distribution of grain sizes can be obtained.

To form high silver chloride content grains, the methods of using bispyridinium compounds disclosed in 25 JP-A-2-32, JP-A-3-137632, JP-A-4-6546, JP-A-5-127279 and JP-A-53231, and the methods disclosed in JP-A-62-293536, JP-A-1155332, JP-A-63-2043, JP-A-63-25643, U.S. Pat. Nos. 4,400,463 and 5,061,617 can be preferably used.

During the process of forming silver halide grains or physical ripening, cadmium salts, zinc salts, lead salts, thallium salts, or iridium salts or complex salts thereof, rhodium salts or complex salts thereof, iron salts or complex salts thereof may be present.

During grain formation or after formation, silver halide solvents may be used (e.g., as known ones, ammonia, thiocyanates, the thioethers and the thione compounds disclosed in U.S. Pat. No. 3,271,157, JP-A-51-12360, JP-A-53-82408, JP-A-53-144319, JP-A-54-100717 and JP-A-54-155828), and when used in combination with the above methods, a silver halide emulsion having a regular crystal form of silver halide and a narrow distribution of grain sizes can be obtained.

Dyes soluble in water may be contained in a hydrophilic colloid layer of a black-and-white photographic material as a filter dye or for the purpose of irradiation prevention or for other various purposes. Examples of such dyes include an oxonol dye, a hemioxonol dye, a styryl dye, a merocyanine dye, a cyanine dye and an azo dye. An oxonol dye, a hemioxonol dye and a merocyanine dye are useful above all.

The various additives described in the following corresponding places can be used in the photographic material of the present invention.

| Item | Places |
|---|---|
| 1) Method of chemical sensitization | line 13, right upper column to line 16, left upper column, page 10 of JP-A-2-68539; and JP-A-5313282 |
| 2) Antifoggant and stabilizer | line 17, left lower column, page 10, to line 7, left upper column, page 11 of JP-A-2-68539; and line 2, left lower column, page 3 to left lower column, page 4 of JP-9-hR539 |
| 3) Tone improving agent | line 7, left lower column, page 2 to line 20, left lower column, page 10 of JP-A-62-276539; and line 15, left lower column, page 6 to line 19, right upper column, page 11 of JP-A-3-94249 |
| 4) Surfactant and antistatic agent | line 14, left upper column, page 11 to line 9, left upper column, page 12 of JP-A-2-68539 |
| 5) Matting agent, sliding agent and plasticizer | line 10, left upper column, page 12 to line 10, right upper column, page 12-of JP-A-2-68539; and line 10, left lower column, page 14 to line 1, right lower column, page 14 of JP-A-2-68539 |
| 6) Hydrophilic colloid | line 11, right upper column, page 12 to line 16, left lower column, page 12 of JP-A-2-68539 |
| 7) Hardening agent | line 17, left lower column, page 12 to line 6, right upper column, page 13 of JP-A-2-68539 |
| 8) Polyhydroxybenzenes | left upper column, page 11 to left lower column, page 12 of JPA-3-39948; and EP-A-452772 |
| 9) Layer constitution | JP-A-3-198041 |

The present invention is described in detail below with reference to the specific examples, but the present invention should not be construed as being limited thereto.

EXAMPLE 1

Preparation of Photographic Material

Preparation of High Sensitivity Tabular Emulsion T-1

6.9 g of potassium bromide and 6.3 g of low molecular weight gelatin having an average molecular weight of 15,000 were added to 1 liter of water, and 37 cc of an aqueous solution of silver nitrate (silver nitrate: 4 g) and-37 cc of an aqueous solution containing 5.9 g of potassium bromide were added by a double jet method, with stirring, to the vessel maintained at 40° C. over 37 seconds. Subsequently, 18.6 g of gelatin was added thereto, then 89 cc of an aqueous solution of silver nitrate (silver nitrate: 9.7 g) was added over 22 minutes with increasing the temperature to 53° C. 5.1 cc of a 25% aqueous solution of ammonia was added to the mixture, and physical ripening was carried out for 10 minutes while maintaining the temperature at 53° C., then 4.7 cc of a 100% acetic acid solution was added. Subsequently, an aqueous solution containing 151.5 g of silver nitrate and an aqueous solution of potassium bromide were added by a controlled double jet method over 35 minutes while maintaining pAg at 8.5 by accelerating the feed rate (initial feed rate/final feed rate=1/5.7). Subsequently, 15 cc of a solution of 2N potassium thiocyanate was added. After physical ripening was carried out over 5 minutes at that temperature, the temperature was lowered to 35° C. The thus obtained grains were pure silver bromide tabular grains having an average projected area diameter of 0.68 μm, a thickness of 0.14 μm, and a variation coefficient of a diameter of 23%.

After soluble salts were removed by flocculation, the temperature was again raised to 40° C., and 35 g of gelatin, 85 mg of Proxel manufactured by ICI (Imperial Chemical Industry) and 0.4 g of sodium polystyrenesulfonate as a thickener were added, and pH and pAg were adjusted to 6.40 and 8.30, respectively, with sodium hydroxide and a silver nitrate solution.

The emulsion obtained was chemical sensitized with stirring while maintaining the temperature at 56° C. First of all, $1\times10^{-5}$ mol/mol Ag of $C_2H_5SO_2SNa$ was added, then 0.002 mol/mol Ag of AgI fine grains having a grain size of 0.03 μm was added, and then 160 mg/mol Ag of 4-hydroxy-6methyl-1,3,3a,7-tetraazaindene and $4\times10^{-4}$ mol/mol Ag, respectively, of Sensitizing Dye I-1 and Sensitizing Dye I-2 were added.

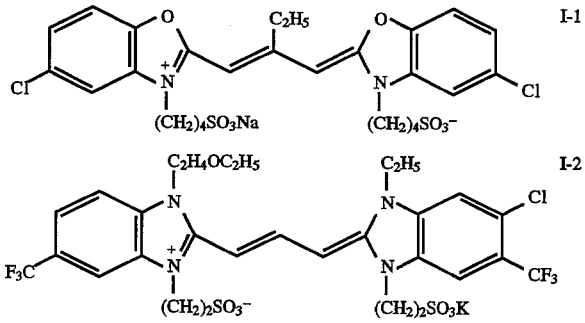

Further, 1.3 mg/mol Ag of sodium thiosulfate, 1.3 mg/mol Ag of Selenium Compound C, 4.5 mg/mol Ag of chloroauric acid and 60 mg/mol Ag of potassium thiocyanate were added, and after 40 minutes the temperature was reduced to 35° C. Thus, the preparation of tabular grain Emuision T-1 was completed.

Selenium Compound

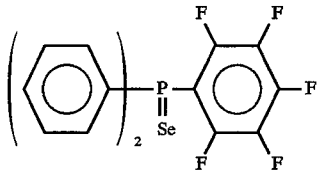

Preparation of Dye Dispersion A for Undercoat Layer

The following Dye-1 was treated by a ball mill according to the method disclosed in JP-A-63-197943.

Dye-1

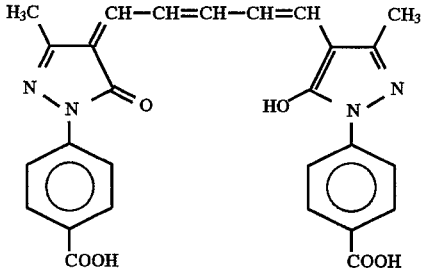

434 ml of water and 791 ml of a 6.7% aqueous solution of Triton X-200 surfactant (TX-200) manufactured by Rohm and Haas Company were put in a ball mill having a capacity of 2 liters. 20 g of the dye was added to the solution. 400 ml of beads of zirconium oxide ($ZrO_2$) (diameter: 2 mm) was added thereto and the content was pulverized over 4 days. Then, 160 g of 12.5% gelatin was added. After defoaming, $ZrO_2$ beads were removed by filtration. As a result of observing the obtained dye dispersion, it was confirmed that the grain sizes of the pulverized dye accounted for a wide range of from 0.05 to 1.15 μm and the average grain size was 0.37 μm.

The dye grains of the grain size of 0.9 μm or more were removed by centrifugal operation.

Thus, Dye Dispersion A was obtained.

Preparation of Support

A biaxially stretched polyethylene terephthalate film colored bluish having a thickness of 175 μm was corona discharged, and the first undercoat solution having the following composition was coated by a wire bar coater so that the coating amount reached 4.9 cc/m$^2$, and then dried at 185° C. for 1 minute.

Then, the first undercoat layer was also coated on the opposite side similarly.

| | |
|---|---|
| Solution of Butadiene-Styrene Copolymer Latex (solid part: 40%, weight ratio of butadiene/styrene = 31/69) | 158 cc |
| A 4% Solution of Sodium 2,4-Dichloro-6-hydroxy-s-triazine | 41 cc |
| Distilled Water | 300 cc |

On the first undercoat layers of both sides of the above support was coated the second undercoat layer having the following composition so as to reach the coating weight indicated below, one by one using a wire bar coater, and then dried at 165° C.

| | |
|---|---|
| Gelatin | 160 mg/m$^2$ |
| Dye Dispersion A (as dye solid part) | 8 mg/m$^2$ |
| $C_{12}H_{25}O(CH_2CH_2O)_{10}H$ | 1.8 mg/m$^2$ |
| Proxel | 0.27 mg/m$^2$ |
| Matting Agent (polymethyl methacrylate having an average particle size of 2.5 μm) | 2.5 mg/m$^2$ |

Thus, the support including a crossover cutting layer was prepared.

Preparation of Coating Solution for Emulsion Layer

A coating solution for the emulsion layer was prepared so that the coating weight per one side of the support of each component to be added to Emulsion T-1 became as indicated below.

| | |
|---|---|
| 2,6-Bis(hydroxyamino)-4-diethylamino-1,3,5-triazine | 1.7 mg/m$^2$ |
| Dextran | 0.45 g/m$^2$ |
| Sodium Polystyrenesulfonate (average molecular weight: 600,000) (including the sodium polystyrene-sulfonate added to the emulsion) | 33 mg/m$^2$ |
| Gelatin (including the gelatin added to the emulsion) | 1.1 g/m$^2$ |
| Hardening Agent 1,2-Bis(vinylsulfonylacetamido)ethane | 41 mg/m$^2$ |
| Compound-1 | 0.11 g/m$^2$ |
| Compound-2 | 0.36 mg/m$^2$ |
| Dye-2 (added as Dye Dispersion B described below) | 0.28 g/m$^2$ |

Compound-1

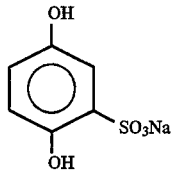

Compound-2

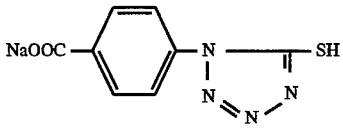

Dye-2

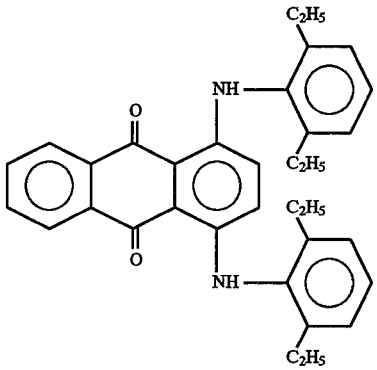

Preparation of Dye Emulsified Product B 60 g of the above Dye-2, 62.8 g of the following High Boiling Point Organic Solvent-1, 62.8 g of the following High Boiling Point Organic Solvent-2, and 333 g of ethyl acetate were dissolved at 60° C. Then, 65 cc of a 5% aqueous solution of sodium dodecylbenzenesulfonate, 94 g of gelatin and 581 cc of water were added to the solution, and dispersed in an emulsion condition using a dissolver at 60° C. over 30 minutes. Then, 2 g of the following Compound-P and 6 liters of water were added and the temperature was reduced to 40° C. Subsequently, the emulsion was concentrated until the total weight reached 2 kg using ultrafiltration labo module ACP1050 manufactured by Asahi Chemical Industry Co., Ltd., and 1 g of the following Compound-P was added thereto to obtain Dye Emulsified Product B.

High Boiling Point Organic Solvent-1

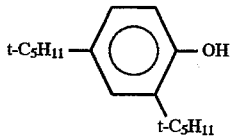

High Boiling Point Organic Solvent-2

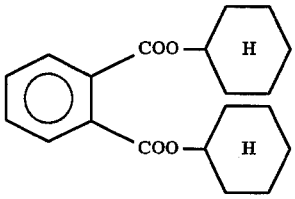

Compound-P

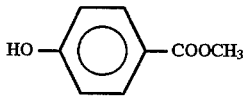

Preparation of Coating Solution for Surface Protective Layer

The surface protective layer was prepared so that the coating weight of each composition per one side of the support became as indicated below.

| | |
|---|---|
| Gelatin | 1.11 g/m$^2$ |
| Proxel | 1.4 mg/m$^2$ |
| Sodium Polyacrylate (average molecular weight: 41,000) | 34 mg/m$^2$ |
| $C_{18}H_{33}O(CH_2CH_2O)_{10}H$ | 35 mg/m$^2$ |
| $C_8F_{17}SO_3K$ | 5.4 mg/m$^2$ |
| Additive-1 | 22.5 mg/m$^2$ |
| Additive-2 | 0.5 mg/m$^2$ |
| Matting Agent-1 (average particle size: 3.7 μm) | 72.5 mg/m$^2$ |
| Compound-3 | 1.3 mg/m$^2$ |
| Compound-4 | 0.5 mg/m$^2$ |

Additive-1

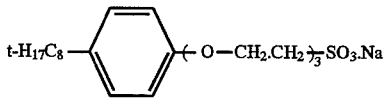

Additive-2

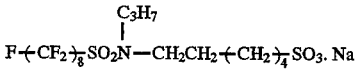

Matting Agent-1

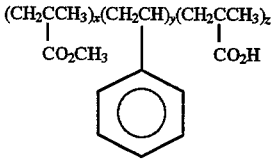

(x/y/z=76.3/17.5/6.2)

Compound-3

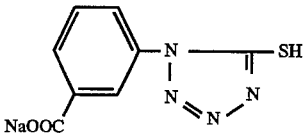

Compound-4

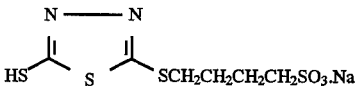

Preparation of Photographic Material S-1

The above prepared emulsion and the coating solution for surface protective layer were coated by a double extrusion method on both sides of the above prepared support one after another under the same condition and Photographic Material S-1 was prepared.

The fed rate of coating solution was set in such a manner that the coating weight of silver per one side of the support became 1.15 g/$^2$ (both sides: 2.3 g/m$^2$.

Swelling factor of the obtained photographic material measured according to the method and definition disclosed in JP-A-58-111933 (corresponding to U.S. Pat. No. 4,414,304) was 170%.

Preparation of Developing Solution

Each developing solution having the formulation shown in Tables 1-1 and 1-2 was prepared. SR-F1 produced by Fuji Photo Film Co., Ltd. was used as a fixing solution.

TABLE 1-1

| Developing Solution No. | 1 Comparison | 2 " | 3 " | 4 " | 5 " | 6 Invention | 7 " | 8 Comparison |
|---|---|---|---|---|---|---|---|---|
| Sodium hydrogensulfite | 8.3 g | " | " | " | " | " | " | " |
| Sodium erythorbate monohydrate | 50.0 g | " | " | " | " | " | " | " |
| Diethylenetriamine-pentaacetic acid | 4.0 g | " | " | " | " | " | " | " |
| Sodium bromide | 10.0 g | " | " | " | " | " | " | " |
| Benzotriazole | 0.4 g | " | " | " | " | " | " | " |
| Compound 8-5 | 0.6 g | " | " | " | " | " | " | " |
| Diethylene glycol | 25.0 g | " | " | " | " | " | " | " |
| 4-Hydroxymethyl-4-methyl-1-phenyl-3-pyrazolidone | 6.0 g | " | n | " | " | " | " | " |
| Potassium hydrogencarbonate | 25.0 g (0.25 mol) | " | " | " | 35.0 g (0.35 mol) | " | " | " |
| Water to make | 1 l | " | " | " | " | " | " | " |
| pH adjusted with NaOH to | 9.1 | 9.3 | 9.7 | 10.0 | 9.1 | 9.3 | 9.7 | 10.0 |

TABLE 1-2

| Developing Solution No. | 9 Comparison | 10 Invention | 11 " | 12 Comparison | 13 " | 14 " | 15 " | 16 " |
|---|---|---|---|---|---|---|---|---|
| Sodium hydrogensulfite | 8.3 g | " | " | " | " | " | " | " |
| Sodium erythorbate monohydrate | 50.0 g | " | " | " | " | " | " | " |
| Diethylenetriamine-pentaacetic acid | 4.0 g | " | " | " | " | " | " | " |
| Sodium bromide | 10.0 g | " | " | " | " | " | " | " |
| Benzotriazole | 0.4 g | " | " | " | " | " | " | " |
| Compound 8-5 | 0.6 g | " | " | " | " | " | " | " |
| Diethylene glycol | 25.0 g | " | " | " | " | " | " | " |
| 4-Hydroxymethyl-4-methyl-1-phenyl-3-pyrazolidone | 6.0 g | " | n | " | " | " | " | " |
| Potassium hydrogencarbonate | 55.1 g (0.55 mol) | " | " | " | 65.1 g (0.65 mol) | " | " | " |
| Water to make | 1 l | " | " | " | " | " | " | " |
| pH adjusted with NaOH to | 9.1 | 9.3 | 9.7 | 10.0 | 9.1 | 9.3 | 9.7 | 10.0 |

Development processing was conducted using automatic processor FPM-1300, a product of Fuji Photo Film Co., Ltd., which was modified so that the open factor of the developing tank was 0.04 $cm^{-1}$ and also the driving gear was modified so that the total processing time was 120 seconds, and operated for 3 weeks. The developing solution was fed with a replenisher for developing solution at the replenishment rate of 150 $ml/m^2$. The reduced amounts by evaporation of the developing tank and the fixing tank were replenished with water one time a day. Photographic ability and stain of the driving gear of the developing rack of the processor were observed with respect to a fresh solution and the solution after 3 week operation. Herein, photographic ability was indicated by sensitivity. The sensitivity is obtained from the reciprocal of the exposure amount providing an optical density of 1.0 and it is shown as a relative sensitivity to that of Developing Solution No. 6 taken as 100. With respect to the stain of the driving gear of the developing rack, "1" means that white powders are generated on the surface of the driving gear and excessive load are imposed on revolution of the drive shaft and further continuous operation is impossible. "5" is the same condition as the starting time with the fresh solution and stain is not generated at all. Evaluation was conducted by 5 grades.

The results obtained are shown in Tables 2-1 and 2-2.

TABLE 2-1

| Developing Solution No. | 1 Comparison | 2 " | 3 " | 4 " | 5 " | 6 Invention | 7 " | 8 Comparison |
|---|---|---|---|---|---|---|---|---|
| Sensitivity | | | | | | | | |
| Fresh solution | 75 | 80 | 90 | 98 | 95 | 100 | 110 | 118 |
| After 3 week operation | 79 | 80 | 90 | 92 | 98 | 100 | 110 | 113 |
| Change of sensitivity | +4 | ±0 | ±0 | −5 | +3 | ±0 | ±0 | −5 |

TABLE 2-1-continued

| Developing Solution No. | 1 Comparison | 2 " | 3 " | 4 " | 5 " | 6 Invention | 7 " | 8 Comparison |
|---|---|---|---|---|---|---|---|---|
| Stain of the driving gear of the developing rack | | | | | | | | |
| Fresh solution | 5 | 5 | 5 | 5 | 5 | 5 | 5 | 5 |
| After 3 week operation | 4 | 4 | 4 | 4 | 4 | 4 | 4 | 4 |

TABLE 2-2

| Developing Solution No. | 9 Comparison | 10 Invention | 11 " | 12 Comparison | 13 " | 14 " | 15 " | 16 " |
|---|---|---|---|---|---|---|---|---|
| Sensitivity | | | | | | | | |
| Fresh solution | 135 | 140 | 150 | 158 | 145 | 150 | 160 | 168 |
| After 3 week operation | 137 | 140 | 150 | 154 | 147 | 150 | 160 | 165 |
| Change of sensitivity | +2 | ±0 | ±0 | −4 | +2 | ±0 | ±0 | −3 |
| Stain of the driving gear of the developing rack | | | | | | | | |
| Fresh solution | 5 | 5 | 5 | 5 | 5 | 5 | 5 | 5 |
| After 3 week operation | 3 | 3 | 3 | 3 | 1 | 1 | 1 | 1 |

As is apparent from the results in Tables 2-1 and 2-2, when the concentration of the potassium hydrogencarbonate of the developing solution was higher, the higher sensitivity could be obtained, but those containing 0.65 mol/liter, such as Developing Solution Nos. 13, 14, 15 and 16, stained the driving gear after 3 week operation, therefore, not preferred. Developing Solution Nos. 1 to 15 each generated a little stain on the driving gear compared with the fresh solution but it was possible to continue driving. However, Developing Solution Nos. 1, 2, 3, 4 and 5 showed low sensitivity and not preferred. On the other hand, with respect to the change of sensitivity after 3 week operation, each of Developing Solution Nos. 1, 5, 9 and 13 having pH 9.1 showed sensitivity increase, but Developing Solution Nos. 4, 8, 12 and 16 having pH 10.0 showed sensitivity reduction. The sensitivity was not changed with respect to solutions having pH 9.3 and 9.7. Judging 20 comprehensively from the above results, those solutions having the concentration of carbonate of from 0.3 to 0.6 mol/liter and pH of from 9.2 to 9.8 did not cause the stain of the driving gear of the developing rack, sensitivity did not change, and sensitivity was not low, accordingly it is apparent that they can provide the most preferred results.

EXAMPLE 2

Preparation of Photographic Material S-2

Photographic Material S-2 was prepared in the same manner as the preparation of Photographic Material S-1 in Example 1, except for replacing high sensitivity tabular Emulsion T-1 with high sensitivity tabular Emulsion T-2 shown below.

Preparation of High Sensitivity Tabular Emulsion T-2

3 g of sodium chloride, low molecular weight gelatin having an average molecular weight of 20,000 and 0.04 g of 4-aminopyrazolo[3,4-d]pyrimidine (produced by Tokyo Kasei Kogyo Co., Ltd.) were added to 820 cc of water, an aqueous solution containing 10.0 g of silver nitrate and an aqueous solution containing 5.61 g of potassium bromide and 0.72 g of potassium chloride were added by a double jet method, with stirring, to the vessel maintained at 55° C. over 30 seconds. Subsequently, an aqueous solution containing 20 g of oxidation-processed gelatin (alkali-processed gelatin processed with hydrogen peroxide) and 6 g of potassium chloride was added thereto, and the reaction solution was allowed to stand for 25 minutes. Then, an aqueous solution containing 155 g of silver nitrate and an aqueous solution containing 87.3 g of potassium bromide and 21.9 g of potassium chloride were added thereto by a double jet method over 58 minutes. The feed rate at this time was accelerated so that the feed rate at the time of termination of the addition reached 3 times that of the starting time of the addition.

Still further, an aqueous solution containing 5 g of silver nitrate and an aqueous solution containing 2.7 g of potassium bromide, 0.6 g of sodium chloride and 0.013 g of $K_4Fe(CN)_6$ were added thereto by a double jet method over 3 minutes. Then, the temperature was lowered to 35° C., and soluble salts were removed by flocculation, the temperature was again raised to 40° C., and 28 g of gelatin, 0.4 g of zinc nitrate and 0.051 g of Proxel were added thereto, and pH was adjusted to 6.0 with sodium hydroxide. Grains having aspect ratio of 3 or more accounted for 80% or more of the projected area of all the grains obtained. The average diameter of the projected area was 0.85 μm, the average thickness was 0.151 μm, and the silver chloride content was 20 mol %.

After the temperature was increased to 56° C., 0.002 mol in terms of silver of silver iodide fine grains (average grain size: 0.05 μm) was added to the reaction mixture while stirring, then 4.8 mg of sodium ethylthiosulfonate, 520 mg of Sensitizing Dye I-1, shown in Example 1, above and 112 mg of 4-hydroxy-6-methyl-1,3,3a,7-tetra-azaindene were added thereto. Further, 1.8 mg of chloroauric acid, 100 mg of potassium thiocyanate, 1.8 mg of sodium thiosulfate pentahydrate and 2.15 mg of Selenium Compound C were added thereto. The solution was chemically ripened for 50 minutes, then suddenly cooled to obtain an emulsion.

The thus prepared Photographic Material S-2 was subjected to exposure giving blackening ratio of 40% which is the nearest to practical use conditions The exposed material was processed using Developing Solution Nos. 5, 6, 7 and 8 of Example 1 at a replenishing rate of 130 ml per $m^2$ of the material and the optimal replenisher composition necessary to maintain the pH and the sodium bromide concentration of the developing solution, and photographic ability was measured under the conditions in which the influence of air oxidation could be ignored even when a large amount of films were processed in a short time. As a result, as indicated in Tables 3-1 and 3-2, Replenisher Nos. 5, 6, 7 and 8 corresponding to Developing Solution Nos. 8, respectively, were obtained.

TABLE 3-1

| | Developing Solution No. 5 Comparison | Replenisher No. 5 | Developing Solution No. 6 Invention | Replenisher No. 6 |
|---|---|---|---|---|
| Sodium hydrogensulfite | 8.3 g | " | " | " |
| Sodium erythorbate monohydrate | 50.0 g | " | " | " |
| Diethylenetriamine-pentaacetic acid | 4.0 g | " | " | " |
| Sodium bromide | 10.0 g | 3.2 g | 10.0 g | 3.2 g |
| Benzotriazole | 0.4 g | " | " | " |
| Compound 8-5 | 0.6 g | " | " | " |
| Diethylene glycol | 25.0 g | " | " | " |
| 4-Hydroxymethyl-4-methyl-1-phenyl-3-pyrazolidone | 6.0 g | " | n | " |
| Potassium hydrogencarbonate | 35.0 g (0.35 mol) | " | " | " |
| Water to make | 1 liter | " | " | " |
| pH adjusted with NaOH to | 9.1 | 9.7 | 9.3 | 9.9 |

TABLE 3-2

| | Developing Solution No. 7 Invention | Replenisher No. 7 | Developing Solution No. 8 Comparison | Replenisher No. 8 |
|---|---|---|---|---|
| Sodium hydrogensulfite | 8.3 g | " | " | " |
| Sodium erythorbate monohydrate | 50.0 g | " | " | " |
| Diethylenetriamine-pentaacetic acid | 4.0 g | " | " | " |
| Sodium bromide | 10.0 g | 3.2 g | 10.0 g | 3.2 g |
| Benzotriazole | 0.4 g | " | " | " |
| Compound 8-5 | 0.6 g | " | " | " |
| Diethylene glycol | 25.0 g | " | " | " |
| 4-Hydroxymethyl-4-methyl-1-phenyl-3-pyrazolidone | 6.0 g | " | n | " |
| Potassium hydrogencarbonate | 35.0 g (0.35 mol) | " | " | " |
| Water to make | 1 liter | " | " | " |
| pH adjusted with NaOH to | 9.7 | 10.3 | 10.0 | 10.6 |

Running test was conducted in combination of Developing Solution No. 5, 6, 7 or 8 and corresponding Replenisher No. 5, 6, 7 or 8, and each running condition was designated running condition 5, 6, 7 or 8, respectively. Running was conducted in such a manner that in one case 1 $m^2$ of the material was processed with 130 ml of the replenisher per a day and in other case 20 $m^2$ of the material was processed per a day with the replenishment rate being 130 ml per $m^2$, and both cases were conducted through 6 weeks. The results obtained are shown in Table 4.

TABLE 4

| Running Condition | 5 | 6 | 7 | 8 |
|---|---|---|---|---|
| Developing Solution Used | Developing Solution No. 5 | Developing Solution No. 6 | Developing Solution No. 7 | Developing Solution No. 8 |
| Replenisher Used | Replenisher No. 5 (Comparison) | Replenisher No. 6 (Invention) | Replenisher No. 7 (Invention) | Replenisher No. 8 (Comparison) |
| Sensitivity | | | | |
| Fresh Solution | 95 | 100 | 110 | 118 |
| After 6 Weeks (processed 1 $m^2$ per a day) | 99 | 100 | 110 | 112 |
| Sensitivity Change | +4 | ±0 | ±0 | −6 |
| Fresh Solution | 95 | 100 | 110 | 118 |
| After 6 Weeks (processed 20 $m^2$ per a day) | 96 | 100 | 110 | 116 |
| Sensitivity Change | +1 | ±0 | ±0 | −2 |

The automatic processor used in this running test and the conditions and definition with respect to sensitivity are the same as those in Example 1. As is apparent from Table 4, when Replenisher No. 5 which is designed to maintain pH 9.1 of Developing Solution No. 5 was used as in running condition 5, sensitivity changed (increase) by 6 week running, therefore this condition was not preferred. On the other hand, by running condition 8 in which a combination of Developing Solution No. 8 having pH 10.0 with Replenisher No. 8 intended to maintain pH 10.0 was used, sensitivity changed (decrease) through 6 week running, in particular, sensitivity was largely decreased by processing of 1 $m^2$ of the material per a day. While when running test was conducted by running conditions 6 and 7 of the present invention, sensitivity did not change in both cases of processing 1 $m^2$ and 20 $m^2$ of the materials per a day.

EXAMPLE 3

The same procedure as in Example 1 in the specification of the present invention was repeated except for using Developing Solution No. 6", 7", 10" or 11" having the formulation shown in Table A below. Developing Solution No. 6", 7", 10" or 11" was prepared by using, as an antifoggant, 1-phenyl-5-mercaptotetrazole instead of Compound 8-5 in Developing Solution No. 6, 7, 10, or 11, respectively.

TABLE A

| Developing Solution No. | 6" | 7" | 10" | 11" |
|---|---|---|---|---|
| Sodium hydrogensulfite | 8.3 g | " | " | " |
| Sodium erythorbate monohydrate | 50.0 g | " | " | " |
| Diethylenetriamine-pentaacetic acid | 4.0 g | " | " | " |
| Sodium bromide | 10.0 g | " | " | " |
| Benzotriazole | 0.4 g | " | " | " |
| 1-Phenyl-5-mercapto-tetrazole (equivalent mol with Compound 8-5) | 0.30 g | " | " | " |
| Diethylene glycol | 25.0 g | " | " | " |
| 4-Hydroxymethyl-4-methyl-1-phenyl-3-pyrazolidone | 6.0 g | " | " | " |
| Potassium hydrogencarbonate | 0.35 mol (0.35 mol) | " | 0.55 mol | " |
| Water to make | 1 liter | " | " | " |
| pH adjusted with NaOH to | 9.3 | 9.7 | 9.3 | 9.7 |

TABLE B

| Developing Solution No. | 6" | 7" | 10" | 11" |
|---|---|---|---|---|
| Replenishing rate ml/$m^2$ | 150 | " | " | " |
| | Comparison | " | " | " |
| Sensitivity | | | | |
| Fresh solution | 50 | 55 | 70 | 75 |
| After 3 week operation | 50 | 55 | 70 | 75 |
| Change of sensitivty | ±0 | ±0 | ±0 | ±0 |
| Stain of the driving gear of the developing rack | | | | |
| Fresh solution | 5 | 5 | 5 | 5 |
| After 3 week operation | 4 | 4 | 3 | 3 |
| Silver stain of developing tank | | | | |
| Fresh solution | 5 | 5 | 5 | 5 |
| After 3 week operation | 3 | 3 | 3 | 3 |

When comparing the thus obtained results with those of Example 1, Developing Solution Nos. 6", 7", 10" and 11" showed low sensitivity and caused the stain of the driving gear of the developing rack.

PREFERRED EMBODIMENTS OF THE INVENTION

1. Preserving method of the developing solution as claimed in claim 1, wherein the developing solution is a 1 part concentrated developing solution.
2. The processing method for the silver halide photographic material as claimed in claim 1, wherein the silver halide photographic material has a swelling factor of 150% or more.
3. The processing method for the silver halide photographic material as claimed in claim 1, wherein the silver halide photographic material comprises a cubic monodisperse silver halide grains having a grain size of 0.4 μm or less.
4. The processing method for the silver halide photographic material as claimed in claim 1, wherein the silver halide grains comprise from 10 to 100 mol % of silver chloride, from 10 to 100 mol % of silver bromide and from 0 to 5% of silver iodide.
5. The processing method as claimed in claim 2, wherein total processing time (Dry to Dry time) is from 20 to 180 sec.
6. The processing method as claimed in claim 2, wherein when a chemical mixer is included within the automatic processor, the processor has the structure such that the cartridges of developing solution and the fixing solution are exhausted at the same time.

7. The processing method as claimed in claim 1, wherein the developing solution substantially does not contain a boron compound.

8. Preserving method of the developing solution as claimed in claim 1, wherein 50 mol % or more of all the cations in 1 part concentrated developing solution is potassium ion.

9. The processing method as claimed in claim 2, wherein the fixing solution contains from 0 to 0.3 mol/liter of a mesoionic compound.

10. The processing method as claimed in claim 1, wherein the developing solution is preserved in a packaging materials having an oxygen permeation coefficient of 50 ml/m$^2$.atm.day (temperature of 20° C. and relative humidity of 65%) or less.

11. The processing method as claimed in claim 2, wherein the open factor of the automatic processor is 0.04 cm$^{-1}$ or less.

12. The processing method as claimed in claim 2, wherein the heating means of the roller part installed in front of the drying zone of the automatic processor to which the photographic material is touched is more.

13. The processing method as claimed in claim 1, wherein the photographic material comprises a transparent support having thereon a colored backing layer and an emulsion layer comprising silver halide grains having {100} face/{111} face ratio of 5 or more and said emulsion layer is spectrally sensitized at 600 nm or more.

14. The processing method as claimed in claim 2, wherein the concentrated developing solution and the concentrated fixing solution each comprises one part and each concentrated solution is diluted with water in each processing tank to provide a working solution and supplied as a replenisher (direct mixing diluting method).

15. The processing method as claimed in claim 2, wherein the container of the concentrated developing solution and the container of the concentrated fixing solution is an integral type package.

16. The processing method as claimed in claim 2, wherein the automatic processor has the structure such that rinsing tank and rinsing roller (crossover roller) are installed between developing tank and fixing tank, and between fixing tank and washing tank.

17. The processing method as claimed in claim 2, wherein the water stock tank which supplies water to washing tank and rinsing tank is equipped with various fungicidal means for preventing scale.

18. The processing method as claimed in claim 2, wherein electromagnetic valve is installed at the exhaust of the washing tank of the processor.

19. The processing method as claimed in claim 2, wherein the washing tank of the automatic processor has multilocular and multistage countercurrent system.

While the invention has been described in detail and with reference to specific examples thereof, it will be apparent to one skilled in the art that various changes and modifications can be made therein without departing from the spirit and scope thereof.

What is claimed is:

1. A processing method for a silver halide photographic material which comprises developing an exposed silver halide photographic material with a developing solution comprising:

(a) an ascorbic acid developing agent, (b) an auxiliary developing agent exhibiting superadditivity, (c) an alkali agent necessary to maintain the pH from 9.2 to 9.8, (d) a carbonate in a concentration from 0.30 mol/liter to 0.60 mol/liter, and (e) a compound represented by formula (I) or (II):

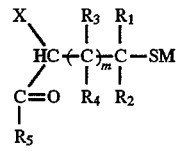

(I)

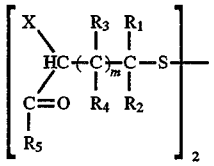

(II)

wherein $R_1$ and $R_2$ each represents a hydrogen atom, an alkyl group having from 1 to 3 carbon atoms or a phenyl group; $R_3$ and $R_4$ each represent a hydrogen atom or an alkyl group having from 1 to 3 carbon atoms; m represents 0, 1 or 2; $R_5$ represents a hydroxyl group, an amino group or an alkyl group having from 1 to 3 carbon atoms; M represents a hydrogen atom, an alkali metal atom or an ammonium group; and X represents a hydrogen atom, an alkyl group having from 1 to 3 carbon atoms, a sulfonyl group, an amino group, an acylamino group, a dimethylamino group, an alkylsulfonylamino group or an arylsulfonylamino group, said compound represented by formula (I) or (II) being present in a concentration of from 0.01 mmol to 50 mmol per liter of the developing solution;

wherein the composition of the developing solution is maintained by feeding the developing solution with a replenisher for the developing solution at a replenishment rate of 50 to 250 ml per m$^2$ of the photographic material.

2. The processing method as claimed in claim 1, wherein said silver halide photographic material is a silver halide X-ray photographic material comprising a support having provided on one or both surfaces thereof at least one silver halide emulsion layer comprising silver halide grains having average aspect ratio of 4 or more, with total silver amount in the emulsion layer or layers being not more than 3.0 g/m$^2$.

3. The processing method as claimed in claim 1, wherein total processing time is from 20 to 180 sec.

4. The processing method as claimed in claim 1, wherein said ascorbic acid developing agent is used in an amount of from 1 to 100 g per liter of the developing solution.

5. The processing method as claimed in claim 1, wherein said ascorbic acid developing agent is used in an amount of from 5 to 80 g per liter of the developing solution.

6. The processing method as claimed in claim 1, wherein said auxiliary developing agent exhibiting superadditivity is selected from the group consisting of 3-pyrazolidone based developing agents and p-aminophenol based developing agents.

7. The processing method as claimed in claim 1, wherein said auxiliary developing agent exhibiting superadditivity is used in an amount of from $10^{-4}$ to $10^{-1}$ mol per liter of the developing solution.

8. The processing method as claimed in claim 1, wherein said auxiliary developing agent exhibiting superadditivity is used in an amount of from $5\times10^{-4}$ to $5\times10^{-2}$ mol per liter of the developing solution.

9. The processing method as claimed in claim 1, wherein said alkali agent necessary to maintain the pH from 9.2 to 9.8 is selected from the group consisting of sodium hydroxide, potassium hydroxide, sodium dihydrogen phosphate, disodium hydrogen phosphate, tripotassium phosphate and dipotassium hydrogen phosphate.

10. The processing method as claimed in claim 1, wherein said developing solution does not contain hydroquinone as a developing agent.

11. The processing method as claimed in claim 1, wherein said compounds represented by formula (I) or (II) are used from 0.1 mmol to 5 mmol per liter of the developing solution.

12. The processing method as claimed in claim 1, wherein said photographic material is a black and white photographic material.

13. The processing method as claimed in claim 1, wherein said ascorbic acid developing agent is selected from one or more compounds selected from the group consisting of an ascorbic acid and derivatives of ascorbic acid.

14. The processing method as claimed in claim 1, wherein said ascorbic acid developing agent is in the form of an alkali metal salt.

15. The processing method as claimed in claim 1, wherein said ascorbic acid developing agent is added to the developing solution in the form of sodium erythorbate monohydrate.

16. The processing method as claimed in claim 13, wherein said derivative of ascorbic acid is selected from the group consisting of L-erythroascorbic acid, 6-desoxy-L-ascorbic acid, L-rhamnoascorbic acid, D-glucoheptoascorbic acid, imino-L-erythroascorbic acid, imino-D-glucoascorbic acid, imimo-6-desoxy-L-ascorbic acid, imino-D-glucoheptoascorbic acid, sodium isoascorbate, L-glycoascorbic acid, D-galactoascorbic acid, L-araboascorbic acid, sorboascorbic acid and sodium ascorbate.

17. The processing method as claimed in claim 1, wherein said carbonate is selected from the group consisting of sodium hydrogen carbonate, sodium carbonate, potassium hydrogen carbonate and potassium carbonate.

18. The processing method of claim 1, wherein said replenishment rate is 100 to 200 ml per $m^2$ of the photographic material.

* * * * *